US009396681B2

(12) United States Patent
In et al.

(10) Patent No.: US 9,396,681 B2
(45) Date of Patent: Jul. 19, 2016

(54) PIXEL CIRCUIT AND ORGANIC LIGHT EMITTING DISPLAY DEVICE USING THE SAME

(71) Applicant: Samsung Display Co., Ltd., Yongin, Gyeonggi-Do (KR)

(72) Inventors: Hai-Jung In, Yongin (KR); Yong-Sung Park, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 106 days.

(21) Appl. No.: 14/228,043

(22) Filed: Mar. 27, 2014

(65) Prior Publication Data

US 2015/0009199 A1 Jan. 8, 2015

(30) Foreign Application Priority Data

Jul. 8, 2013 (KR) ..... 10-2013-0079495

(51) Int. Cl.
*G09G 3/32* (2006.01)

(52) U.S. Cl.
CPC ..... *G09G 3/3266* (2013.01); *G09G 3/3233* (2013.01); *G09G 2300/0852* (2013.01); *G09G 2300/0861* (2013.01); *G09G 2310/0278* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,947,331 | B2 * | 2/2015 | Hwang | G09G 3/003 315/169.3 |
| 9,041,704 | B2 * | 5/2015 | Lee | H01L 27/3262 257/40 |
| 9,148,930 | B2 * | 9/2015 | Chung | H05B 33/0896 |
| 2011/0227505 | A1 | 9/2011 | Park et al. | |
| 2012/0113077 | A1 * | 5/2012 | Kang | G09G 3/003 345/211 |

FOREIGN PATENT DOCUMENTS

| | | | |
|---|---|---|---|
| KR | 10-2011-0104705 | A | 9/2011 |
| KR | 10-2012-0048294 | A | 5/2012 |

* cited by examiner

*Primary Examiner* — Van Chow
(74) *Attorney, Agent, or Firm* — Knobbe, Martens, Olson & Bear, LLP

(57) ABSTRACT

A pixel circuit including an organic light emitting diode (OLED), a first transistor, a first capacitor, a second transistor, a second capacitor and a third transistor is disclosed. In one aspect, the first transistor controls the amount of current flowing from a first power source to a second power source via the OLED, corresponding to a voltage at a first node. The first capacitor has a first terminal connected to a data line. The second transistor is connected between a second terminal of the first capacitor and a second node. The second capacitor is connected between the second node and the first node. The third transistor is connected between a fixed voltage source and the second terminal of the first capacitor, and has a turn-on period non-overlapping with that of the second transistor.

21 Claims, 4 Drawing Sheets

PIXEL CIRCUIT AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2013-0079495, filed on Jul. 8, 2013, in the Korean Intellectual Property Office, the entire contents of which are incorporated herein by reference in their entirety.

BACKGROUND

1. Field

The described technology generally relates to a pixel circuit and an organic light emitting display device using the same.

2. Description of the Related Technology

There are various types of flat panel display devices have reduced weight and volume compared to cathode ray tubes. The flat panel display technologies include liquid crystal display device (LCD), a field emission display device, plasma display panel (PDP), organic light emitting diode (OLED) display, and the like.

The organic light emitting display device displays images using organic light emitting diodes (OLEDs) that emit light through recombination of electrons and holes. OLED displays usually have a fast response speed and are driven with relatively low power consumption.

SUMMARY OF CERTAIN INVENTIVE ASPECTS

One inventive aspect is to provide a pixel circuit and an organic light emitting display device using the same, which can improve display quality.

According to another inventive aspect of the described technology, there is a pixel circuit including: an OLED; a first transistor configured to control the amount of current flowing from a first power source to a second power source via the OLED, corresponding to a voltage at a first node; a first capacitor configured to have a first terminal connected to a data line; a second transistor connected between a second terminal of the first capacitor and a second node; a second capacitor connected between the second node and the first node; and a third transistor connected between a fixed voltage source and the second terminal of the first capacitor, the third transistor having a turn-on period non-overlapping with that of the second transistor.

The pixel circuit may include a fourth transistor connected between the first power source and the second node, the fourth transistor having a turn-on period at least partially overlapped with that of the third transistor; and a fifth transistor connected between the first node and an initialization power source, the fifth transistor having a turn-on period non-overlapping with those of the second and third transistors.

The fixed voltage source may be the initialization power source.

The initialization power source may be set to a voltage lower than that of the first power source.

The pixel circuit may further include a sixth transistor connected between the second node and the data line, the sixth transistor being turned on or turned off together with the fifth transistor; a seventh transistor connected in parallel to the sixth transistor between the second node and the data line, the seventh transistor having a turn-on period non-overlapping with those of the second, third and fifth transistors; an eighth transistor connected between a second electrode of the first transistor and the first node, the eighth transistor being turned on or turned off together with the seventh transistor; a ninth transistor connected in parallel to the eighth transistor between the second electrode of the first transistor and the first node, the ninth transistor being turned on or turned off together with the second transistor; and a tenth transistor connected between the second electrode of the first transistor and an anode electrode of the OLED, the tenth transistor being turned on or turned off together with the fourth transistor.

The pixel circuit may further include an eleventh transistor connected between the initialization power source and the anode electrode of the OLED, the eleventh transistor being turned on or turned off together with the fifth transistor.

According to another inventive aspect of the described technology, there is an organic light emitting display device, including: pixels positioned in an area defined by scan lines and data lines; a scan driver configured to supply the scan lines and an emission control line connected to the pixels; a control driver configured to drive first, second and third control lines connected to the pixels; and a data driver configured to drive the data lines, wherein each pixel positioned on an i-th (i is a natural number) horizontal line includes: an OLED; a first transistor configured to control the amount of current flowing from a first power source to a second power source via the OLED, corresponding to a voltage at a first node; a first capacitor configured to have a first terminal connected to a data line; a second transistor connected between a second terminal of the first capacitor and a second node, the second transistor being turned on when a third control signal is supplied to the third control line; a second capacitor connected between the second node and the first node; and a third transistor connected between a fixed voltage source and the second terminal of the first capacitor, the third transistor being turned on when a scan signal is supplied to an i-th scan line.

Each pixel circuit may include a fourth transistor connected between the first power source and the second node, the fourth transistor being turned off when an emission control signal is supplied to the emission control line and turned on otherwise; and a fifth transistor connected between the first node and an initialization power source, the fifth transistor being turned on when a first control signal is supplied to the first control line.

The fixed voltage source may be the initialization power source.

The initialization power source may be set to a voltage lower than that of the first power source.

Each pixel circuit may further include a sixth transistor connected between the second node and the data line, the sixth transistor being turned on when the first control signal is supplied; a seventh transistor connected in parallel to the sixth transistor between the second node and the data line, the seventh transistor being turned on when a second control signal is supplied to the second control line; an eighth transistor connected between a second electrode of the first transistor and the first node, the eighth transistor being turned on when the second control signal is supplied; a ninth transistor connected in parallel to the eighth transistor between the second electrode of the first transistor and the first node, the ninth transistor being turned on when the third control signal is supplied; and a tenth transistor connected between the second electrode of the first transistor and an anode electrode of the OLED, the tenth transistor being turned off when the emission control signal is supplied and turned on otherwise.

Each pixel circuit may further include an eleventh transistor connected between the initialization power source and the anode electrode of the OLED, the eleventh transistor being turned on when the first control signal is supplied.

One frame may be divided into first to fourth periods. The control driver may supply the first control signal to the first control line during the first period, supply the second control signal to the second control line during the second period, and supply the third control signal to the third control line during the third period.

The scan driver may progressively supply a scan signal to the scan lines during the fourth period.

The scan driver may supply an emission control signal to the emission control line during the first to third periods.

The data driver may supply a data signal to the data lines, in synchronization with the scan signal progressively supplied to the scan lines, during the fourth period.

The data driver may supply a first reference voltage to the data lines during the first and second periods, and supply a second reference voltage to the data lines during the third period.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION OF CERTAIN INVENTIVE EMBODIMENTS

Figure 1:
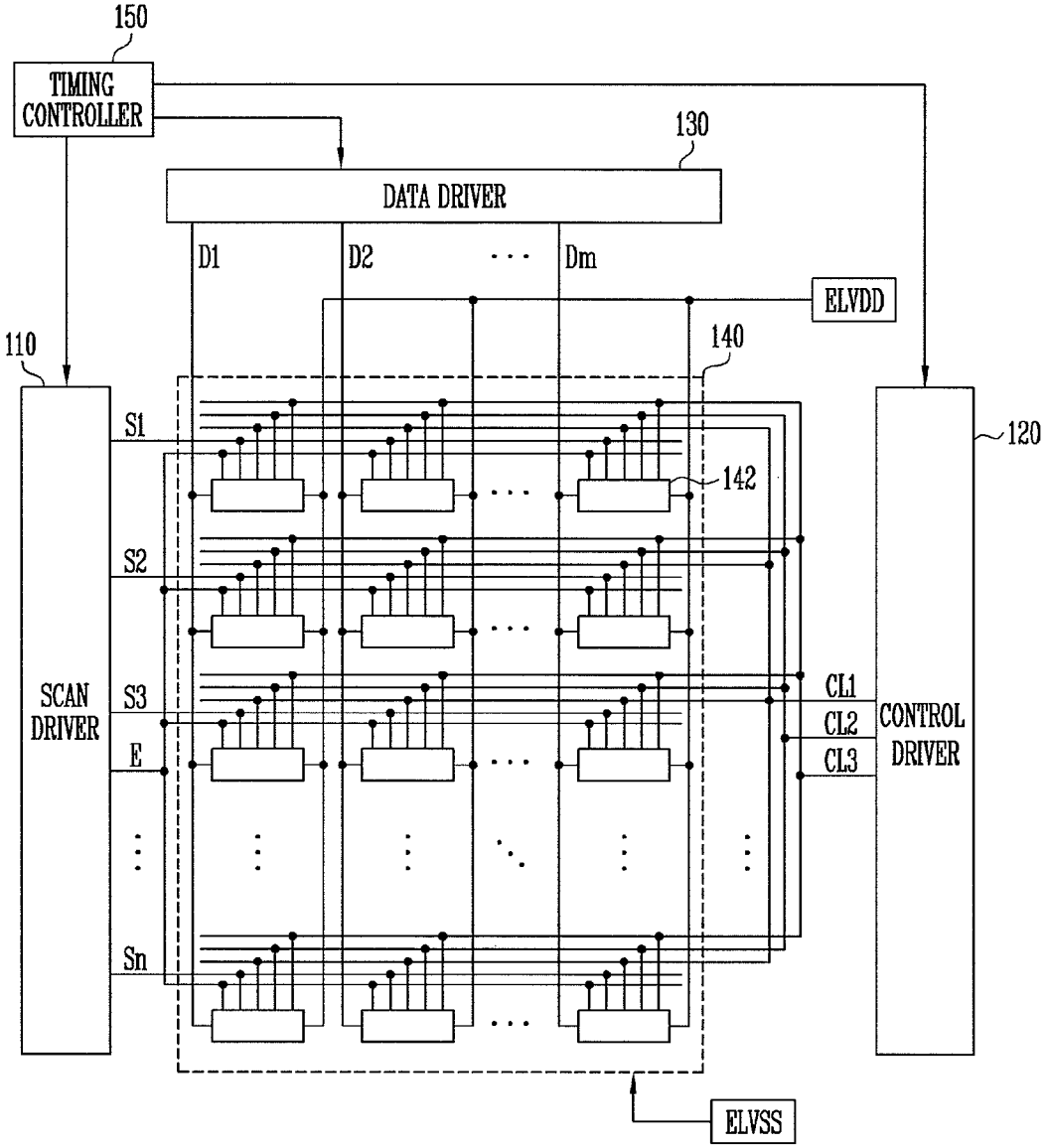
FIG. 1 is an exemplary diagram illustrating an organic light emitting display device according to an embodiment of the described technology.

Hereinafter, certain exemplary embodiments according to the described technology will be described with reference to the accompanying drawings. Here, when a first element is described as being coupled to a second element, the first element may be not only directly coupled to the second element but may also be indirectly coupled to the second element via a third element. Here, when a first element is described as being connected to a second element, the first element may be not only directly connected to the second element but may also be indirectly connected to the second element via a third element. In this disclosure, the term "connected" includes "electrically connected." Like reference numerals refer to like elements throughout.

FIG. 1 is an exemplary diagram illustrating an organic light emitting display device according to an embodiment of the described technology.

Referring to FIG. 1, the organic light emitting display device according to this embodiment includes a pixel unit 140 including pixels 142 positioned in an area defined by scan lines S1 to Sn and data lines D1 to Dm, a scan driver 110 configured to drive the scan lines S1 to Sn and an emission control line E, a control driver 120 configured to drive a first control line CL1, a second control line CL2 and a third control line CL3, a data driver 130 configured to drive the data lines D1 to Dm, and a timing controller 150 configured to control the scan driver 110, the control driver 120 and the data driver 130.

Figure 3:
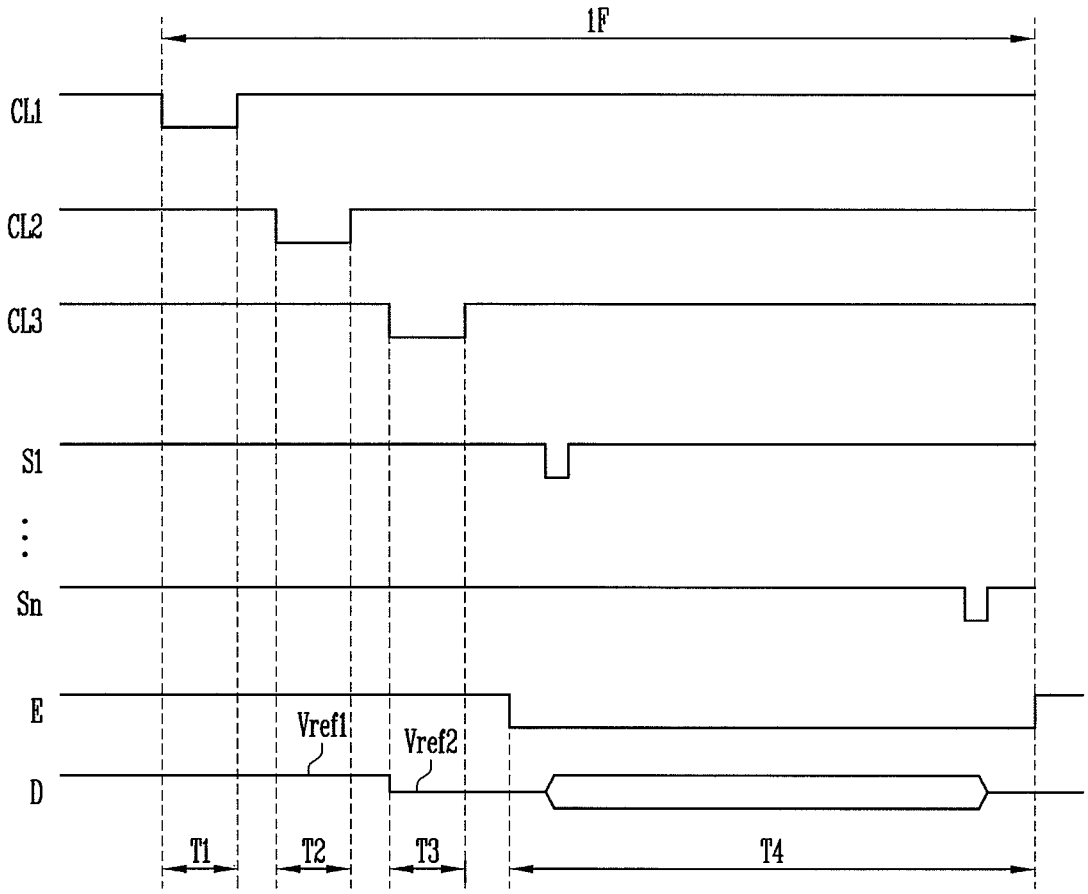
FIG. 3 is an exemplary waveform diagram illustrating an embodiment of a driving method that can be used with the pixel shown in FIG. 2.

The scan driver 110 supplies a scan signal to the scan lines S1 to Sn. For example, the scan driver 110, as shown in FIG. 3, progressively supplies the scan signal to the scan lines S1 to Sn during a fourth period T4 in one frame 1F. The scan driver 110 supplies an emission control signal to the emission control line E commonly connected to the pixels 142. For example, the scan driver 110 may supply the emission control signal to the emission control line E during a third period T3 in the one frame 1F. Here, the scan signal supplied from the scan driver 110 is set to a voltage (e.g., a low voltage) at which transistors included in the pixels 142 are turned on, and the emission control signal is set to a voltage (e.g., a high voltage) at which the transistors are turned off.

The control driver 120 supplies first, second and third control signals to the respective first, second and third control lines CL1, CL2 and CL3 commonly connected to the pixels 142. For example, the control driver 120 supplies the first control signal during a first period T1 in the one frame 1F, and supplies the second control signal during a second period T2 in the one frame 1F. In addition, the control driver 120 supplies the third control signal during the third period T3 in the one frame 1F. Here, the first, second and third control signals are set to a voltage (e.g., a low voltage) at which transistors included in each pixels 142 can be turned on.

The data driver 130 supplies a first reference voltage Vref1 to the data lines D1 to Dm during the first and second periods T1 and T2 in the one frame 1F, and supplies a second reference voltage Vref2 to the data lines D1 to Dm during the third period T3 in the one frame 1F. The data driver 130 supplies the data signal to the data lines D1 to Dm in synchronization with the scan signal during the fourth period T4 in the one frame 1F. Here, the data driver 130 may alternately supply left and right data signals every frame for 3D driving.

Meanwhile, although it has been illustrated in FIG. 3 that the second reference voltage Vref2 is lower than the first reference voltage Vref1, the described technology is not limited thereto. Practically, the first and second reference voltages Vref1 and Vref2 are voltages at which gray scales are implemented, together with the voltage of a data signal, and may be set as various voltages in consideration of inches of a panel, resolution, expression ability of gray scales, etc.

The timing controller 110 controls the scan driver 110, the control driver 120 and the data driver 130, corresponding to a synchronization signal supplied from the outside of the organic light emitting display device.

The pixel unit 140 includes the pixels 142 defined by the scan lines S1 to Sn and the data lines D1 to Dm. Each pixel 142 implements a predetermined gray scale while controlling the amount of current flowing a first power source ELVDD to a second power source ELVSS via an OLED (not shown).

Meanwhile, it has been illustrated in FIG. 1 that, for convenience of illustration, the emission control line E is connected to the scan driver 110 and the control lines CL1, CL2 and CL3 are connected to the control driver 120, the described technology is not limited thereto. Practically, the emission control line E and the control lines CL1, CL2 and CL3 may be connected to various drivers. For example, each of the emission control line E and the control lines CL1, CL2 and CL3 may be connected to the scan driver 110.

Figure 2:
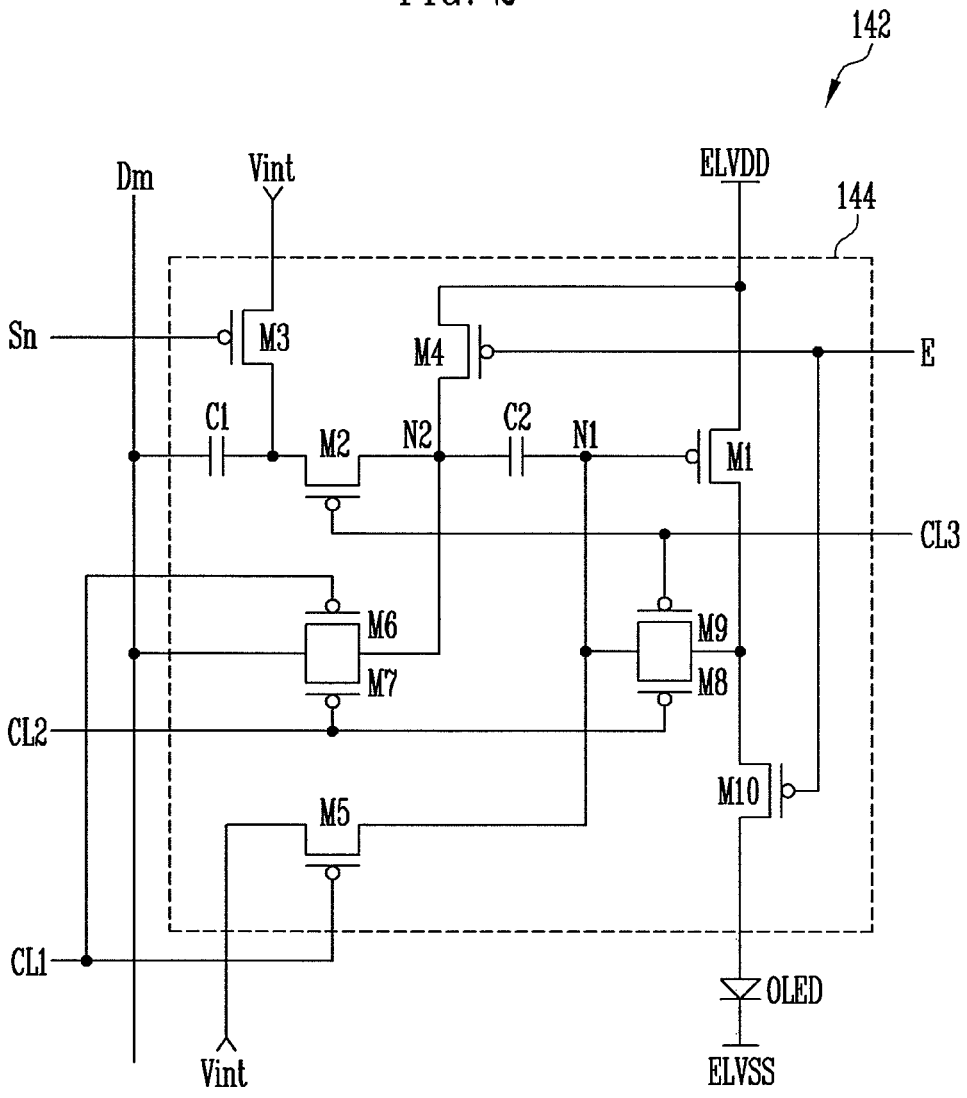
FIG. 2 is an exemplary circuit diagram illustrating a pixel according to one embodiment of the described technology.

FIG. 2 is an exemplary circuit diagram illustrating a pixel according to a first embodiment of the described technology. For convenience of illustration, a pixel connected to an m-th data line Dm and an n-th scan line Sn will be shown in FIG. 2.

Referring to FIG. 2, the pixel 142 according to this embodiment includes an OLED and a pixel circuit 144 configured to control the amount of current supplied to the OLED.

An anode electrode of the OLED is connected to the pixel circuit 144, and a cathode electrode of the OLED is connected to the second power source ELVSS. The OLED generates light with a predetermined luminance corresponding to the amount of current supplied from the pixel circuit 144. Meanwhile, the second power source ELVSS is set to a voltage lower than that of the first power source ELVDD so that current can flow through the OLED.

The pixel circuit 144 controls the amount of current supplied to the OLED, corresponding to a data signal. To this end, the pixel circuit 144 includes first to tenth transistors M1 to M10, a first capacitor C1 and a second capacitor C2.

A first electrode of the first transistor (driving transistor) M1 is connected to the first power source ELVDD, and a second electrode of the first transistor M1 is connected to a first electrode of the tenth transistor M10. A gate electrode of the first transistor M1 is connected to a first node N1. The first transistor M1 controls the amount of the current supplied to the OLED, corresponding to a voltage applied to the first node N1.

A first electrode of the second transistor M2 is connected to a second terminal of the first capacitor C1, and a second electrode of the second transistor M2 is connected to a second node N2. A gate electrode of the second transistor M2 is connected to the third control line CL3. The second transistor M2 is turned on when the third control signal is supplied to the third control line CL3, to allow the second terminal of the first capacitor C1 and the second node N2 to be electrically connected to each other.

A first electrode of the third transistor M3 is connected to the second terminal of the first capacitor C1, and a second electrode of the third transistor M3 is connected to an initialization power source Vint. A gate electrode of the third transistor M3 is connected to the scan line Sn. The third transistor M3 is turned on when the scan signal is supplied to the scan line Sn, to supply the voltage of the initialization power source Vint to the second terminal of the first capacitor C1.

Meanwhile, although it has been illustrated in FIG. 2 that the second electrode of the third transistor M3 is connected to the initialization power source Vint, the described technology is not limited thereto. Practically, the second electrode of the third transistor M3 may be electrically connected to any one of voltage sources (fixed voltage sources) supplied to the pixel 142 so that the voltage at the second terminal of the first capacitor C1 can be stably maintained.

A first electrode of the fourth transistor M4 is electrically connected to the first power source ELVDD, and a second electrode of the fourth transistor M4 is electrically connected to the second node N2. A gate electrode of the fourth transistor M4 is electrically connected to the emission control line E. The fourth transistor M4 is turned off when the emission control signal is supplied to the emission control line E, and is turned on when the emission control signal is not supplied.

A first electrode of the fifth transistor M5 is electrically connected to the first node N1, and a second electrode of the fifth transistor M5 is electrically connected to the initialization power source Vint. A gate electrode of the fifth transistor M5 is electrically connected to the first control line CL1. The fifth transistor M5 is turned on when the first control signal is supplied to the first control line CL1, to supply the voltage of the initialization power source Vint to the first node N1. Here, the initialization power source Vint is set to a voltage lower than that of the first power source ELVDD so that the threshold voltage of the first transistor M1 can be compensated.

A first electrode of the sixth transistor M6 is electrically connected to the data line Dm, and a second electrode of the sixth transistor M6 is electrically connected to the second node N2. A gate electrode of the sixth transistor M6 is electrically connected to the first control line CL1. The sixth transistor M6 is turned on when the first control signal is supplied to the first control line CL1, to allow the data line Dm and the second node N2 to be electrically connected to each other.

The seventh transistor M7 is electrically connected in parallel to the sixth transistor M6 between the data line Dm and the second node N2. A gate electrode of the seventh transistor M7 is electrically connected to the second control line CL2. The seventh transistor M7 is turned on when the second control signal is supplied to the second control line CL2, to allow the data line Dm and the second node N2 to be electrically connected to each other.

A first electrode of the eighth transistor M8 is electrically connected to the second electrode of the first transistor M1, and a second electrode of the eighth transistor M8 is electrically connected to the first node N1. A gate electrode of the eighth transistor M8 is electrically connected to the second control line CL2. The eighth transistor M8 is turned on when the second control signal is supplied to the second control line CL2, to allow the first transistor M1 to be diode-electrically connected.

The ninth transistor M9 is electrically connected in parallel to the eighth transistor M8 between the second electrode of the first transistor M1 and the first node N1. A gate electrode of the ninth transistor M9 is electrically connected to the third control line CL3. The ninth transistor M9 is turned on when the third control signal is supplied to the third control line CL3, to allow the first transistor M1 to be diode-electrically connected.

The first electrode of the tenth transistor M10 is electrically connected to the second electrode of the first transistor M1, and a second electrode of the tenth transistor M10 is electrically connected to the anode electrode of the OLED. A gate electrode of the tenth transistor M10 is electrically connected to the emission control line E. The tenth transistor M10 is turned off when the emission control signal is supplied to the emission control line E, and is turned on when the emission control signal is not supplied.

The first capacitor C1 is electrically connected between the data line Dm and the first electrode of the second transistor M2. The first capacitor C1 charges a voltage corresponding to the data signal during a period in which the OLED emits light.

The second capacitor C2 is electrically connected between the second and first nodes N2 and N1. The second capacitor C2 charges the voltage charged in the first capacitor C1 and a voltage corresponding to the threshold voltage of the first transistor M1.

FIG. 3 is an exemplary waveform diagram illustrating an embodiment of a driving method of the pixel shown in FIG. 2.

Referring to FIG. 3, one frame 1F according to this embodiment is divided into first to fourth periods T1 to T4.

The first period T1 is an initialization period in which the voltage of the initialization power source Vint is supplied to the first node N1. The second period T2 is a compensation period in which a voltage corresponding to the threshold voltage of the first transistor M1 is charged in the second capacitor C2. The third period T3 is a data transmission period in which the second capacitor C2 is charged using a data signal of a previous frame, charged in the first capacitor C1. The fourth period T4 is an emission period in which the amount of current supplied to the OLED is controlled corresponding to the voltage charged in the second capacitor C2, and simultaneously, a data signal of a current frame is stored in the first capacitor C1.

The emission control signal is supplied during the first to third periods T1 to T3, and is not supplied during the fourth period T4. The fourth and tenth transistors M4 and M10 are turned off during the first to third periods T1 to T3 in which the emission control signal is supplied. If the fourth transistor M4 is turned off, the first power source ELVDD and the second node N2 are electrically decoupled from each other. If the tenth transistor M10 is turned off, the first transistor M1 and the OLED are electrically decoupled from each other. Thus, the OLED is set in a non-emission state during the first to third periods T1 to T3.

The fourth and tenth transistors M4 and M10 are turned on during the fourth period T4 in which the emission control signal is not supplied. Then, the OLED and the first transistor M1 are electrically connected to each other, and accordingly, the OLED can generate light with a predetermined luminance corresponding to the amount of current from the first transistor M1.

An operation of the pixel will be described in detail. The first control signal is supplied to the first control line CL1 during the first period T1.

If the first control signal is supplied to the first control line CL1, the fifth and sixth transistors M5 and M6 are turned on. If the fifth transistor M5 is turned on, the voltage of the initialization power source Vint is supplied to the first node N1. If the sixth transistor M6 is turned on, the data line Dm and the second node N2 are electrically connected to each other. In this case, the first reference voltage Vref1 supplied to the data line Dm is supplied to the second node N2. That is, during the first period T1, the first node N1 is initialized with the voltage of the initialization power source Vint, and the second node N2 is initialized with the first reference voltage Vref1. Here, the first reference voltage Vref1 is set as a voltage higher than that of the initialization power source Vint.

The second control signal is supplied to the second control line CL2 during the second period T2. If the second control signal is supplied to the second control line CL2, the seventh and eighth transistors M7 and M8 are turned on. If the eighth transistor M8 is turned on, the first transistor M1 is diode-electrically connected. Here, the voltage at the first node N1 is initialized with the voltage of the initialization power source Vint, which is a voltage lower than that of the first power source ELVDD, and hence the first transistor M1 is turned on. If the first transistor M1 is turned on, the voltage at the first node N1 is increased to a voltage obtained by subtracting the absolute threshold voltage of the first transistor M1 from the voltage of the first power source ELVDD.

If the seventh transistor M7 is turned on, the data line Dm and the second node N2 are electrically connected to each other. Then, the first reference voltage Vref1 from the data line Dm is supplied to the second node N2 during the second period T2. In this case, the second capacitor C2 charges a voltage corresponding to the difference in voltage between the first and second nodes N1 and N2. Here, the first reference voltage Vref1 and the voltage of the first power source ELVDD are previously set as constant voltages, and hence the voltage stored in the second capacitor C2 is determined by the threshold voltage of the first transistor M1. That is, a voltage corresponding to the threshold voltage of the first transistor M1 is charged in the second capacitor C2 during the second period T2.

The third control signal is supplied to the third control line CL3 during the third period T3. If the third control signal is supplied to the third control line CL3, the second and ninth transistors M2 and M9 are turned on. The second reference voltage Vref1 is supplied to the data line Dm during the third period T3. The second reference voltage Vref2 is set as a voltage higher than that of the initialization power source Vint.

If the ninth transistor M9 is turned on, the first transistor M1 is diode-electrically connected. In this case, the voltage at the first node N1 is maintained as a voltage obtained by subtracting the absolute threshold voltage of the first transistor M1 from the voltage of the first power source ELVDD.

If the second transistor M2 is turned on, the second terminal of the first capacitor C1 and the second node N2 are electrically connected to each other. In this case, the voltage at the second node N2 is set as shown in Equation 1 by charge sharing of the first and second capacitors C1 and C2.

$$V_{N2} = \frac{C1(Vint + Vref2 - Vdata) + C2Vref1}{C1 + C2} \quad \text{Equation 1}$$

In Equation 1, Vdata denotes the voltage of a data signal of a previous frame, charged in the first capacitor C1.

Subsequently, during the fourth period T4, the scan signal is progressively supplied to the scan lines S1 to Sn, and simultaneously, the supply of the emission control signal to the emission control line E is stopped. If the supply of the emission control signal to the emission control line E is stopped, the fourth and tenth transistors M4 and M10 are turned on.

If the fourth transistor M4 is turned on, the voltage of the first power source ELVDD is supplied to the second node N2. In this case, the voltage at the first node N1 is determined as shown in Equation 2 by coupling of the second capacitor C2.

$$V_{N1} = ELVDD - |VthM1| + ELVDD - \frac{C1(Vint + Vref2 - Vdata) + C2Vref1}{C1 + C2} \quad \text{Equation 2}$$

In Equation 2, VthM1 denotes the threshold voltage of the first transistor M1.

If the tenth transistor M10 is turned on, the first transistor M1 and the anode electrode of the OLED are electrically connected to each other. In this case, the current flowing through the OLED, corresponding to the voltage applied to the first node N1, is set as shown in Equation 3.

$$I = \frac{1}{2}\mu C_{ox}\frac{W}{L}(ELVDD - V_{N1} - |VthM1|)^2 \quad \text{Equation 3}$$

-continued $$= \frac{1}{2}\mu C_{ox}\frac{W}{L}\left[\frac{C1(Vint + Vref2 - Vdata) + C2Vref1}{C1 + C2} - ELVDD\right]^2$$

In Equation 3, μ denotes the mobility of the first transistor M1, $C_{ox}$ denotes the gate capacitance of the first transistor M1, and W and L denote the channel width/length ratio of the first transistor M1. Referring to Equation 3, the current supplied to the OLED is determined regardless of the threshold voltage of the first transistor M1.

Meanwhile, if the scan signal is supplied to the scan line Sn during the fourth period T4, the third transistor M3 is turned on. If the third transistor M3 is turned on, the voltage of the initialization power source Vint is supplied to the second terminal of the first capacitor C1. Then, the first capacitor C1 charges a voltage corresponding to the data signal of the current frame, supplied to the data line Dm. Subsequently, if the supply of the scan signal to the scan line Sn is stopped, the second terminal of the first capacitor C1 is set in a floating state. Thus, the charged voltage is maintained regardless of the data signal supplied to the data line Dm. Practically, in the described technology, a predetermined image is implemented by repeating the aforementioned procedure.

Figure 4:
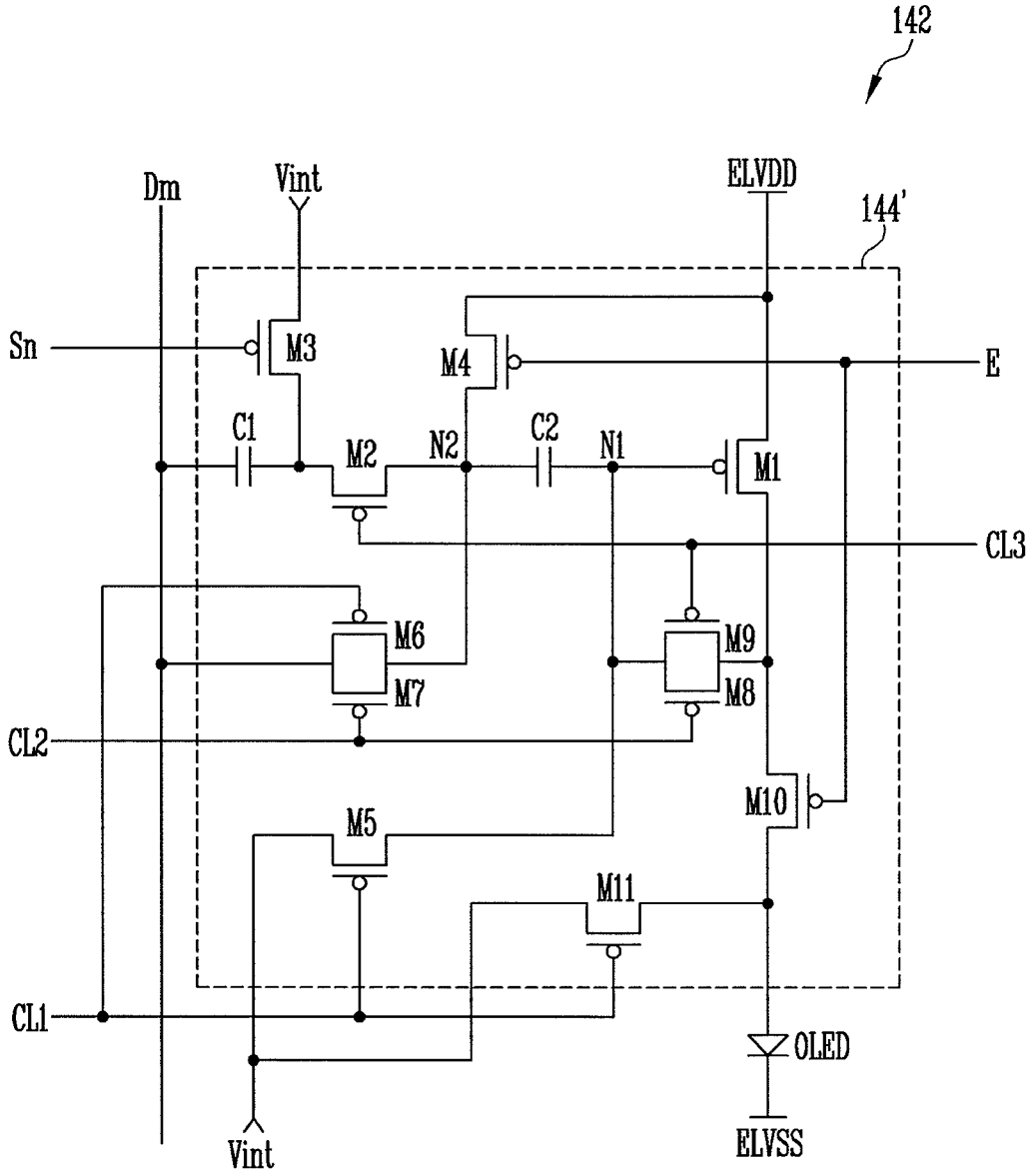
FIG. 4 is an exemplary circuit diagram illustrating a pixel according to another embodiment of the described technology.

FIG. 4 is a circuit diagram illustrating a pixel according to a second embodiment of the described technology. In FIG. 4, components identical to those of FIG. 2 are designate by like reference numerals, and their detailed descriptions will be omitted.

Referring to FIG. 4, the pixel 142 according to this embodiment, includes a pixel circuit 144' and the OLED.

The pixel circuit 144' further include an eleventh transistor M11 electrically connected between the anode electrode of the OLED and the initialization power source Vint. The eleventh transistor M11 is turned on when the first control signal is supplied to the first control line CL1, to supply the voltage of the initialization power source Vint to the anode electrode of the OLED.

That is, during the first period T1, the eleventh transistor M11 is turned on to initialize the anode electrode of the OLED as the voltage of the initialization power source Vint. The operation of the pixel 142 except the eleventh transistor M11 is identical to that of the aforementioned embodiment of the described technology, and therefore, its detailed description will be omitted.

Meanwhile, although it has been described in the described technology that the transistors are shown as PMOS transistors for convenience of illustration, the described technology is not limited thereto. In other words, the transistors may be formed as NMOS transistors.

In the described technology, the OLED generates light of a specific color, corresponding to the amount of current supplied from the driving transistor. However, the described technology is not limited thereto. For example, the OLED may generate white light, corresponding to the amount of the current supplied from the driving transistor. In this case, a color image is implemented using a separate color filter or the like.

By way of summation and review, an organic light emitting display device can include a plurality of pixels arranged in a matrix form at intersection portions of a plurality of data lines, a plurality of scan lines and a plurality of power lines. Each pixel generally includes an OLED, two or more transistors including a driving transistor, and one or more capacitors.

The organic light emitting display device has low power consumption. However, the amount of current flowing through the OLED depending on a variation in threshold voltage of the driving transistor included in each pixel, and therefore, display inequality is caused. That is, the characteristic of the driving transistor is changed depending on manufacturing process variables of the driving transistor included in each pixel In order to solve such a problem, there has been proposed a method of adding, to each pixel, a compensation circuit including a plurality of transistor and a capacitor. The compensation circuit included in each pixel charges a voltage corresponding to the threshold voltage of a driving transistor during one horizontal period, and accordingly, a variation in the threshold voltage of the driving transistor is compensated.

The compensation circuit is driven at a driving frequency of about 120 Hz or more in order to prevent a motion blur phenomenon and/or to implement 3D images. However, in a case where the compensation circuit is driven at a high frequency of about 120 Hz or more, the period required to charge the threshold voltage of the driving transistor is shortened, and therefore, it can be difficult to compensate for the threshold voltage of the driving transistor.

In the pixel and the organic light emitting display device using the same according to the described technology, the threshold voltages of pixels are simultaneously compensated, so that it is possible to sufficiently secure a threshold voltage compensation period, thereby improving the display quality of the organic light emitting display device.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A pixel circuit, comprising:

an organic light emitting diode (OLED);

a first transistor configured to control the amount of current flowing from a first power source to a second power source via the OLED, corresponding to a voltage at a first node;

a first capacitor configured to have a first terminal electrically connected to a data line;

a second transistor electrically connected between a second terminal of the first capacitor and a second node;

a second capacitor connected between a control electrode of the first transistor and a non-control electrode of the second transistor; and a third transistor electrically connected between a fixed voltage source and the second terminal of the first capacitor, the third transistor configured to have a turn-on period that is non-overlapping with that of the second transistor.

2. The pixel circuit of claim 1, comprising:

a fourth transistor electrically connected between the first power source and the second node, the fourth transistor having a turn-on period at least partially overlapping with that of the third transistor; and a fifth transistor electrically connected between the first node and an initialization power source, the fifth transistor having a turn-on period non-overlapping with those of the second and third transistors.

3. The pixel circuit of claim 2, wherein the fixed voltage source is the initialization power source.

4. The pixel circuit of claim 2, wherein the initialization power source is configured to supply a voltage lower than that of the first power source.

5. The pixel circuit of claim 2, further comprising:

a sixth transistor electrically connected between the second node and the data line, the sixth transistor configured to be turned on or turned off together with the fifth transistor;

a seventh transistor electrically connected in parallel to the sixth transistor between the second node and the data line, the seventh transistor configured to have a turn-on period non-overlapping with those of the second, third and fifth transistors;

an eighth transistor electrically connected between a second electrode of the first transistor and the first node, the eighth transistor configured to be turned on or turned off together with the seventh transistor;

a ninth transistor electrically connected in parallel to the eighth transistor between the second electrode of the first transistor and the first node, the ninth transistor configured to be turned on or turned off together with the second transistor; and a tenth transistor electrically connected between the second electrode of the first transistor and an anode electrode of the OLED, the tenth transistor configured to be turned on or turned off together with the fourth transistor.

6. The pixel circuit of claim 2, further comprising an eleventh transistor electrically connected between the initialization power source and the anode electrode of the OLED, the eleventh transistor configured to be turned on or turned off together with the fifth transistor.

7. An organic light emitting display device, comprising:

a plurality of pixels formed in an area defined by intersecting scan lines and data lines;

a scan driver configured to drive the scan lines and an emission control line electrically connected to the pixels;

a control driver configured to drive first, second and third control lines electrically connected to the pixels; and a data driver configured to drive the data lines, wherein each pixel positioned on an i-th (i is a natural number) horizontal line includes:

an OLED;

a first transistor configured to control the amount of current flowing from a first power source to a second power source via the OLED, corresponding to a voltage at a first node;

a first capacitor configured to have a first terminal electrically connected to a data line;

a second transistor electrically connected between a second terminal of the first capacitor and a second node, the second transistor configured to be turned on when a third control signal is supplied to the third control line;

a second capacitor connected between a control electrode of the first transistor and a non-control electrode of the second transistor; and a third transistor electrically connected between a fixed voltage source and the second terminal of the first capacitor, the third transistor configured to be turned on when a scan signal is supplied to an i-th scan line.

8. The organic light emitting display device of claim 7, wherein each pixel includes:

a fourth transistor electrically connected between the first power source and the second node, the fourth transistor configured to be turned off when an emission control signal is supplied to the emission control line and turned on otherwise; and a fifth transistor electrically connected between the first node and an initialization power source, the fifth transistor configured to be turned on when a first control signal is supplied to the first control line.

9. The organic light emitting display device of claim 8, wherein the fixed voltage source is the initialization power source.

10. The organic light emitting display device of claim 8, wherein the initialization power source is configured to supply a voltage lower than that of the first power source.

11. The organic light emitting display device of claim 8, wherein each pixel further includes:

a sixth transistor electrically connected between the second node and the data line, the sixth transistor configured to be turned on when the first control signal is supplied;

a seventh transistor electrically connected in parallel to the sixth transistor between the second node and the data line, the seventh transistor configured to be turned on when a second control signal is supplied to the second control line;

an eighth transistor electrically connected between a second electrode of the first transistor and the first node, the eighth transistor configured to be turned on when the second control signal is supplied;

a ninth transistor electrically connected in parallel to the eighth transistor between the second electrode of the first transistor and the first node, the ninth transistor configured to be turned on when the third control signal is supplied; and a tenth transistor electrically connected between the second electrode of the first transistor and an anode electrode of the OLED, the tenth transistor configured to be turned off when the emission control signal is supplied and turned on otherwise.

12. The organic light emitting display device of claim 8, wherein each pixel further includes an eleventh transistor electrically connected between the initialization power source and the anode electrode of the OLED, the eleventh transistor configured to be turned on when the first control signal is supplied.

13. The organic light emitting display device of claim 7, wherein at least one frame is divided into first to fourth periods, and wherein the control driver is configured to supply the first control signal to the first control line during the first period, is further configured to supply the second control signal to the second control line during the second period, and is further configured to supply the third control signal to the third control line during the third period.

14. The organic light emitting display device of claim 13, wherein the scan driver is configured to progressively supply a scan signal to the scan lines during the fourth period.

15. The organic light emitting display device of claim 14, wherein the scan driver is further configured to supply an emission control signal to the emission control line during the first to third periods.

16. The organic light emitting display device of claim 14, wherein the data driver configured to supply a data signal to the data lines, in synchronization with the scan signal progressively supplied to the scan lines, during the fourth period.

17. The organic light emitting display device of claim 13, wherein the data driver is configured to supply a first reference voltage to the data lines during the first and second periods, and supplies a second reference voltage to the data lines during the third period.

18. An organic light emitting display device, comprising:

a plurality of pixels connected to a plurality of scan lines and a plurality of data lines;

a scan driver configured to drive the scan lines electrically connected to the pixels;

a control driver configured to drive first, second and third control lines electrically connected to the pixels; and a data driver configured to drive the data lines, wherein at least one pixel comprises:

an OLED;

a first transistor configured to control the amount of current flowing from a first power source to the OLED;

a first capacitor having a first terminal electrically connected to a data line;

a second transistor electrically connected between a second terminal of the first capacitor and a second node;

a second capacitor connected between a control electrode of the first transistor and a non-control electrode of the second transistor; and a third transistor electrically connected between a fixed voltage source and the second terminal of the first capacitor.

19. The organic light emitting display device of claim 18, wherein the at least one pixel further comprises:

a fourth transistor electrically connected between the first power source and the second node; and a fifth transistor electrically connected between the first node and an initialization power source.

20. The organic light emitting display device of claim 18, wherein at least one display frame is divided into first to fourth periods, and wherein the control driver is configured: to supply the first control signal to the first control line during the first period, to supply the second control signal to the second control line during the second period, and to supply the third control signal to the third control line during the third period.

21. The pixel circuit of claim 1, wherein the first transistor is directly connected to the first power source.

* * * * *